US007713083B1

(12) United States Patent
Sun et al.

(10) Patent No.: US 7,713,083 B1
(45) Date of Patent: May 11, 2010

(54) JUMPER DEVICE FOR CONTROLLING CONNECTION OF PINS OF ELECTRICAL DEVICE ON MAINBOARD

(75) Inventors: Zheng-Heng Sun, Taipei Hsien (TW); Xiao-Feng Ma, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (CN)

( * ) Notice: Subject to any disclaimer, the term of this patent is extended or adjusted under 35 U.S.C. 154(b) by 0 days.

(21) Appl. No.: 12/339,064

(22) Filed: Dec. 19, 2008

(30) Foreign Application Priority Data

Dec. 4, 2008 (CN) ..... 200810305967

(51) Int. Cl.
*H01R 13/08* (2006.01)

(52) U.S. Cl. ..... 439/507

(58) Field of Classification Search ..... 439/507, 439/509, 512, 513, 52, 510; 200/292, 16 C
See application file for complete search history.

(56) References Cited

U.S. PATENT DOCUMENTS 4,417,107 A * 11/1983 Terajima ..... 200/16 C
6,191,373 B1 * 2/2001 Liao ..... 200/16 A
7,520,775 B2 * 4/2009 Wu et al. ..... 439/507
2008/0194138 A1 * 8/2008 Wu et al. ..... 439/507

* cited by examiner

*Primary Examiner*—Chandrika Prasad
(74) *Attorney, Agent, or Firm*—Zhigang Ma

(57) ABSTRACT

A jumper device configured for adjusting connections between a number of pins of a jumper block includes a non-conductive casing, a number of conductive members, and a switch. The non-conductive casing includes a number of slots in linear alignment defined in the casing and through a bottom of the casing, and a sliding groove communicating with tops of the slots. The conductive members each include a top wall, disposed in the plurality of slots and configured for electrically connecting with the plurality of pins of the jumper block respectively. The top wall of each of two alternate conductive members includes a conductive tab. The switch is slidably disposed in the sliding groove configured to selectively connecting the top walls of two adjacent conductive members, or connecting the tabs of two alternate conductive members, thereby electrically connecting two corresponding pins of the jumper block.

11 Claims, 5 Drawing Sheets

JUMPER DEVICE FOR CONTROLLING CONNECTION OF PINS OF ELECTRICAL DEVICE ON MAINBOARD

CROSS-REFERENCE TO RELATED APPLICATION

Reference is made to a co-pending U.S. patent application entitled "JUMPER DEVICE" filed on Aug. 21, 2007 with application Ser. No. 11/842,164, and assigned to the same assignee as that of the present application. The co-pending application is hereby incorporated by reference.

BACKGROUND

1. Technical Field

The present disclosure relates to jumper devices and, particularly, to a jumper device for conveniently controlling connection of pins of electrical devices on a mainboard.

2. Description of Related Art

In electronic devices, particularly, computers, a jumper is a short length conductor used to close a break in or bypass part of an electrical circuit. Jumpers are typically used to set up or adjust printed circuit boards, such as the mainboards of computers. Jumper pins (points to be connected by the jumper) are arranged in groups called jumper blocks, with each group having at least one pair of contact points and often more. In general, each contact in a jumper block terminates in a small metal pin. An appropriately sized conductive sleeve called a jumper, or more technically, a jumper shunt, is slipped over the pins to complete the circuit. FIG. 1 is a schematic illustration showing a related-art jumper 110. The jumper 110 is used to slip onto a jumper block 120 of a mainboard. The jumper block 120 has a plurality of pins A, B, and C, which are electrically connected to electrical components (not shown). When the jumper 110 is used on the jumper block 120, two pins of the jumper block 120 are connected to each other to form a closed circuit (ON state). Therefore, current may flow between the two pins. When the jumper 110 is removed, the two pins are an open in the circuit (OFF state).

In general, the jumper 110 is placed in a package for the mainboard when the jumper 110 is not in use. However, once the jumper 110 is removed from the mainboard, the jumper 110 may be lost or misplaced and cannot easily be found because the size of the jumper 110 is very small, which will bring inconvenience to the user.

Therefore, what is needed is to provide a jumper device to overcome the above-described shortcomings.

DETAILED DESCRIPTION

Figure 1:
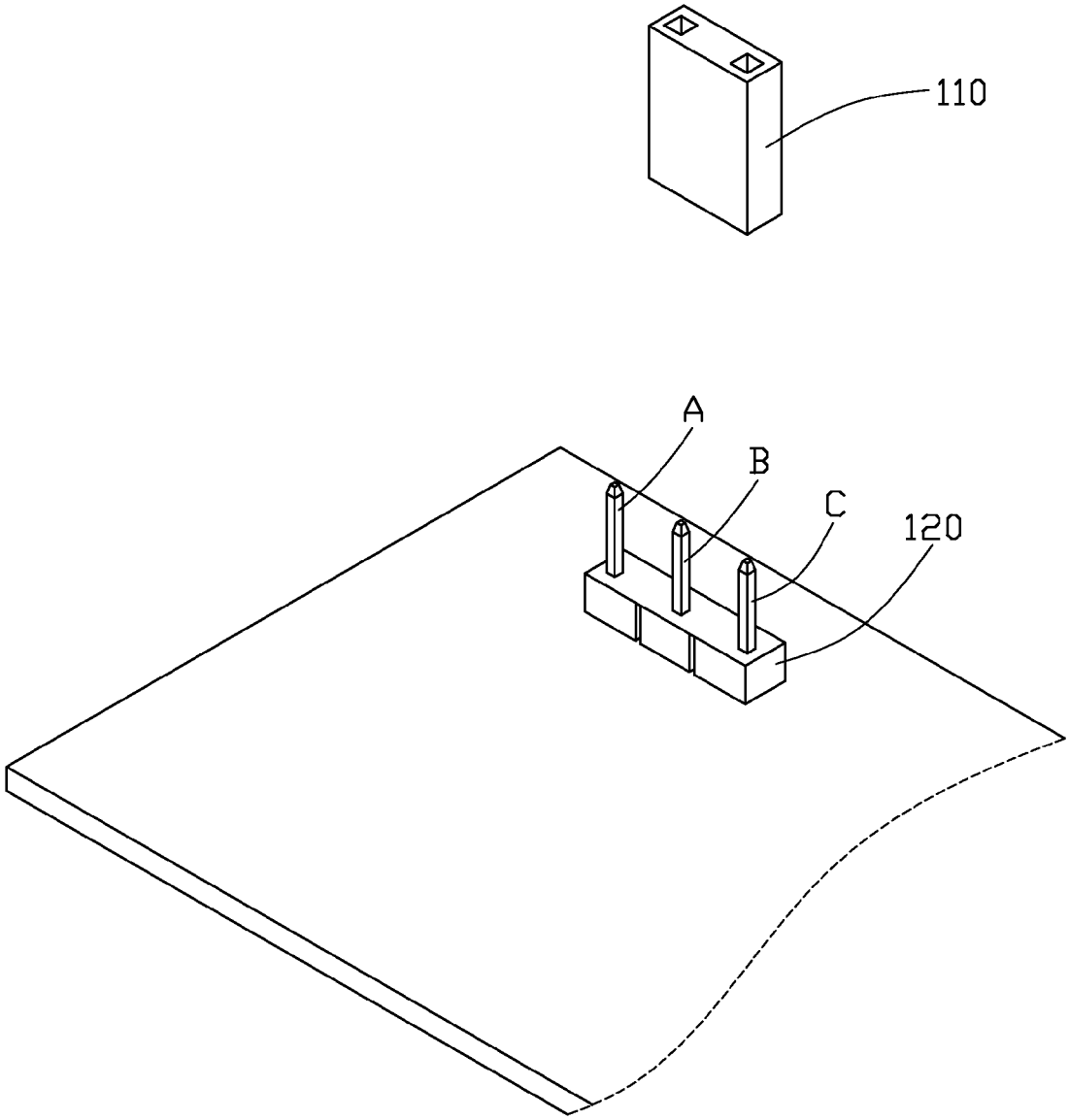
FIG. 1 (RELATED ART)
FIG. 1 is a schematic view of a related-art jumper device, together with a jumper block on a mainboard.
Figure 2:
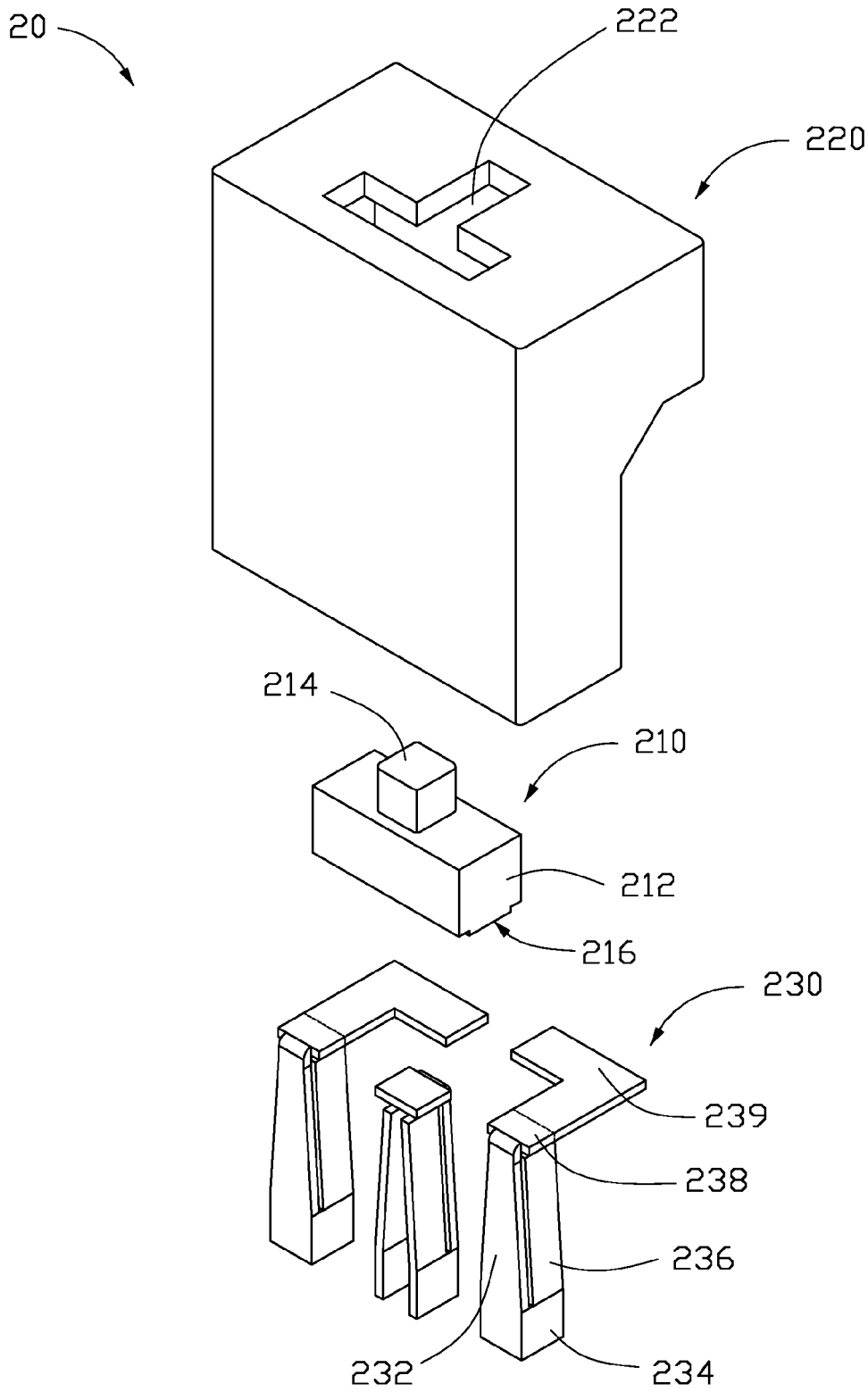
FIG. 2 is an exploded, schematic view of an embodiment of a jumper device.
Figure 3:
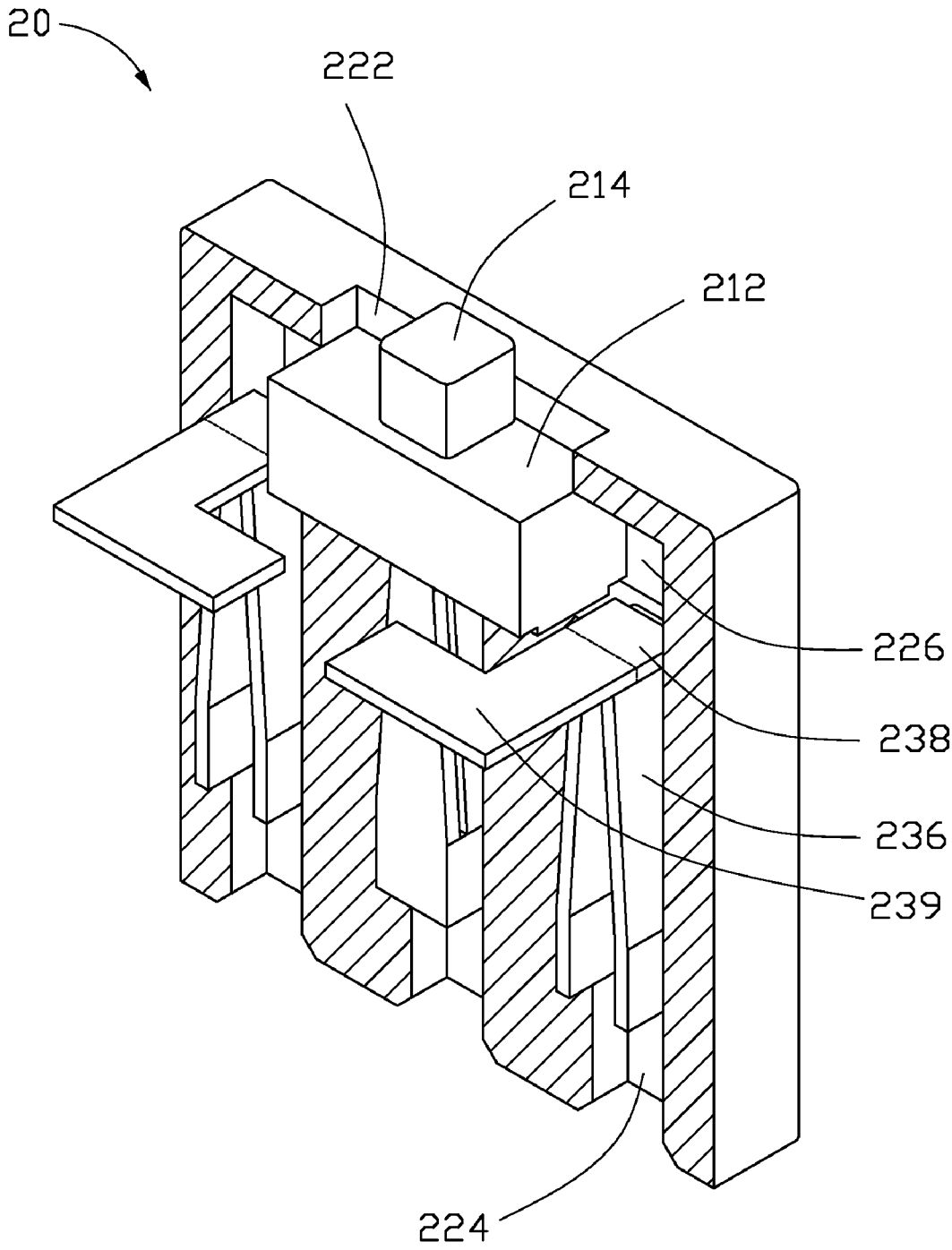
FIG. 3 is an assembled, cutaway view of the jumper device of FIG. 2.

Referring to FIGS. 2 and 3, an exemplary embodiment of a jumper device 20 includes a casing 220, three conductive members 230, and a switch 210. In other embodiments, the number of the conductive members 230 can be changed according to need.

The casing 220 is approximately L-shaped and made of non-conductive material. Three slots 224 are defined in the casing 220 perpendicular to and through a bottom of the casing 220. A sliding groove 226 is disposed at and communicates with tops of the slots 224. A T-shaped opening 222 is defined in a top wall of the casing 220, in communication with the sliding groove 226.

The conductive members 230 are unconnected to each other and made of conductive material, and for being received in slots 224 of the casing 220 in linear alignment. Each conductive member 230 includes an upright connecting portion 232. Two sidewalls 234 extend perpendicularly from two opposite sides of a lower portion of the connecting portion 232 in the same direction. Two elastic slices 236 extend up slantwise from the two sidewalls 234. A top wall 238 is bent horizontally from a top edge of the connecting portion 232. Gaps are defined between the elastic slices 236 and the connecting portion 232, and between the elastic slices 236 and the top wall 238, for providing elastic deformation space. The top wall 238 of each conductive member 230 located at opposite ends of the linear arrangement thereof, extends to form an L-shaped tab 239. With the initial legs of the L-shapes extending parallel with each other and then extending toward each to complete L-shapes facing each other. The conductive members 230 are firmly fixed in the corresponding slots 224. When the jumper device 20 is used on a jumper block, the conductive members 230 clamp corresponding pins of the jumper block and assure a proper electrical connection between the pins.

The switch 210 includes a sliding block 212, a conductive sheet 216 attached at a bottom surface of the sliding block 212, and a grip handle 214 disposed at a top surface of the sliding block 212. The sliding block 212 is slidably accommodated in the sliding groove 226 with the grip handle 214 exposed from the opening 222 of the casing 220.

Figure 4:
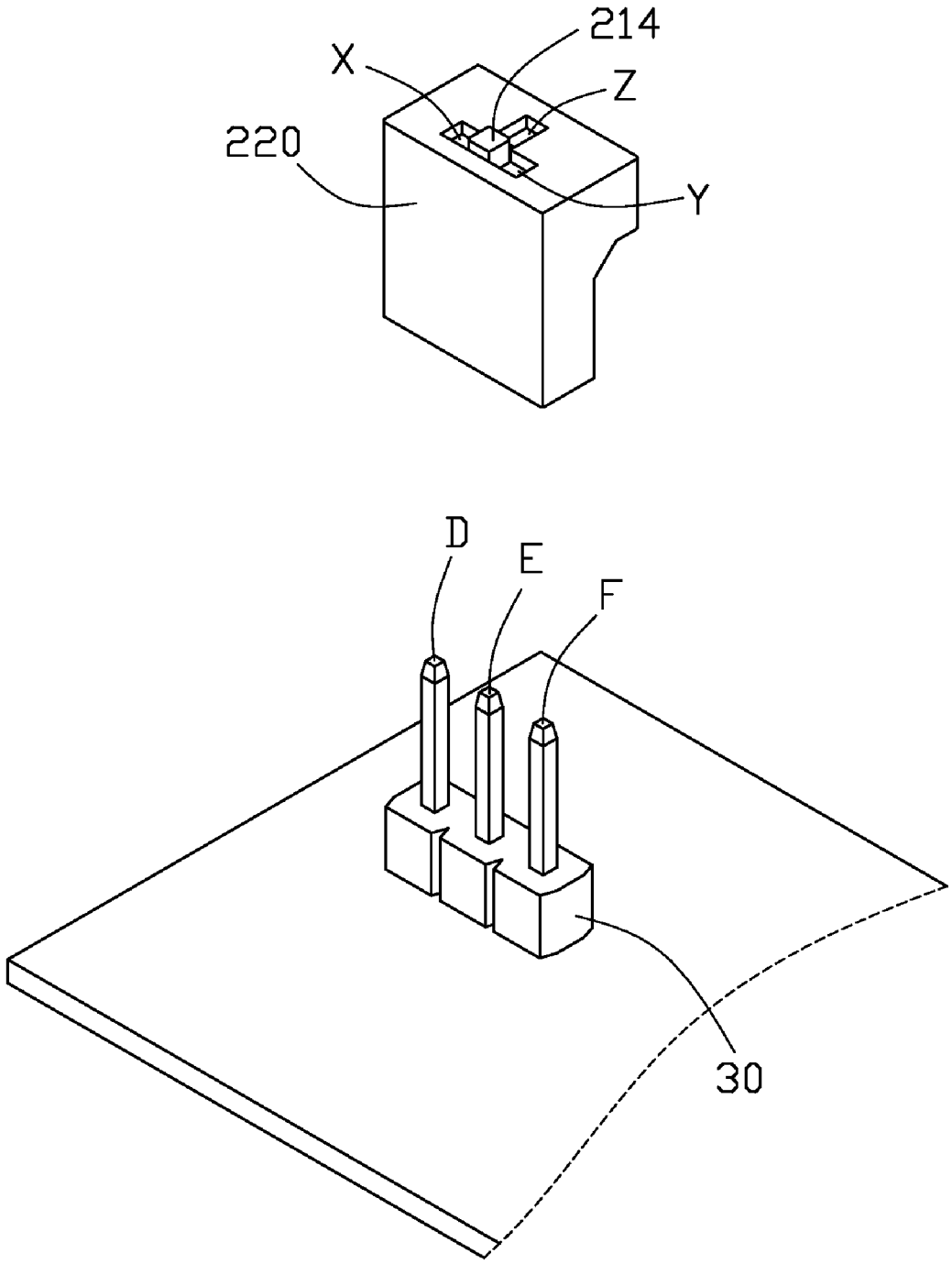
FIG. 4 is an assembled view of the jumper device of FIG. 2, together with a jumper block on a mainboard.
Figure 5:
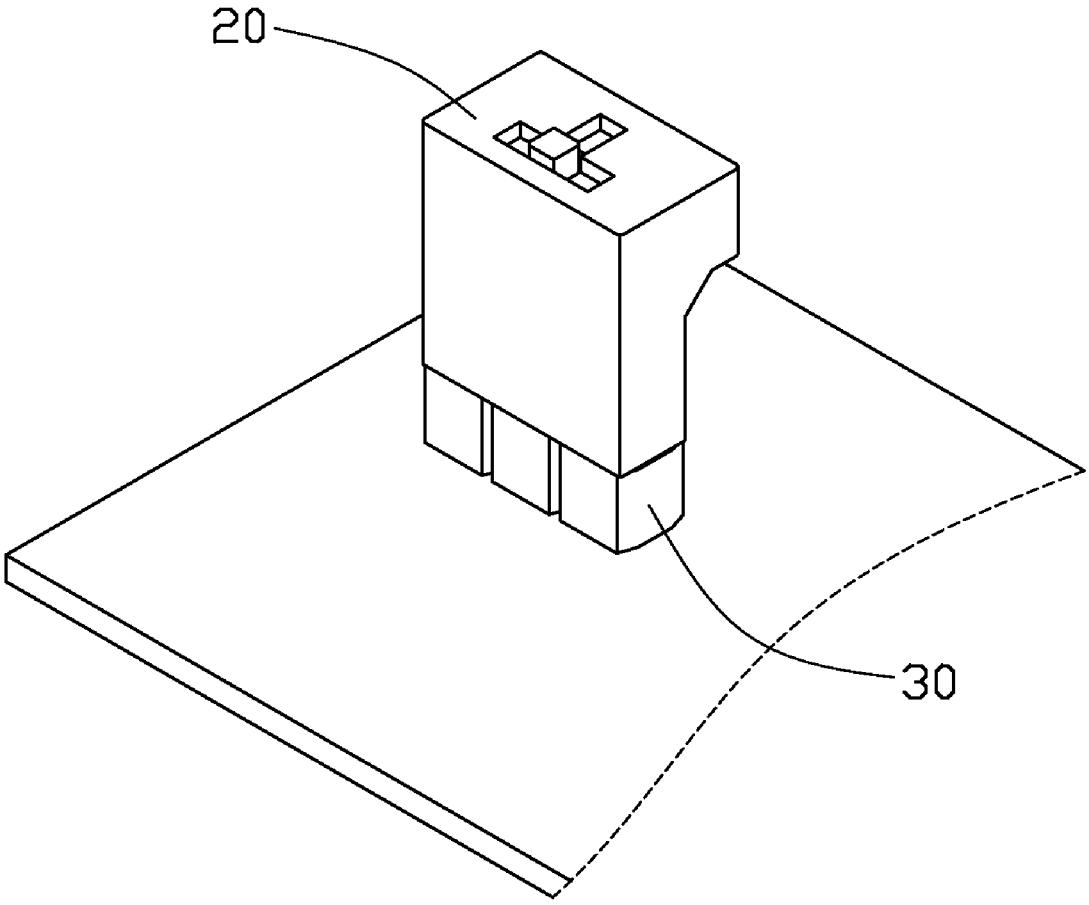
FIG. 5 is an assembled view of the jumper device applied on the jumper block of FIG. 4.

Referring to FIGS. 4 and 5, in use, the jumper device 20 can remain on a jumper block 30, and connections of any two pins of pins D, E, F of the jumper block 30 can be switched by moving the sliding block 212 to different positions. For example, when the grip handle 214 is moved to an X position located at a left side, the sliding block 212 connects the left one and the middle one of the conductive members 230, thereby connecting the pins D, E of the jumper block 30; when the grip handle 214 is moved to a Y position located the a right side, the sliding block 212 connects the middle one and the right one of the conductive members 230, thereby connecting the pins E, F of the jumper block 30; when the grip handle 214 is moved to a Z position located at a side of the X and Y positions, the sliding block 212 connects the left one and the right one of the conductive members 230, thereby connecting the pins D, F of the jumper block 30; when the grip handle 214 is moved to a neutral position that is the middle between the X and Y positions, the sliding block 212 only connects with the middle one of the conductive members 230.

In the above embodiments, users can conveniently change connections of pins of the jumper block by driving the grip handle 214 to slide the sliding block 212 to different positions. Therefore, when the jumper is not needed, it can remain in place with the switch 210 at a predetermined neutral position. Thus, the user does not have to worry about the loss of the jumper device.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A jumper device configured for adjusting connections between a plurality of pins of a jumper block on a mainboard, the jumper device comprising:

a non-conductive casing having a plurality of slots in linear alignment defined in the casing and through a bottom of the casing, and a sliding groove communicating with tops of the slots;

a plurality of conductive members in linear alignment each comprising a top wall, disposed in the plurality of slots, and configured for electrically connecting with the plurality of pins of the jumper block respectively; wherein the top walls of each two nonadjacent conductive members of the plurality of conductive members has a conductive tab that extends therefrom; and a switch, slidably disposed in the sliding groove, configured to be slidable along the linear alignment to connect the top walls of two adjacent conductive members, thereby electrically connecting two corresponding adjacent pins of the jumper block, or be slidable along a direction perpendicular to the linear alignment to connect the conductive tabs of the two nonadjacent conductive members, thereby electrically connecting two corresponding nonadjacent pins of the jumper block.

2. The jumper device of claim 1, wherein the casing comprises a top wall defining an opening therein, in communication with the sliding groove, configured to expose the switch.

3. The jumper device of claim 2, wherein the switch comprises a sliding block, a conductive sheet attached at a bottom surface of the sliding block, and a grip handle disposed at a top surface of the sliding block, the sliding block is slidably accommodated in the sliding groove with the grip handle exposed from the opening of the casing.

4. The jumper device of claim 1, wherein each of the conductive members further comprises an upright connecting portion, two sidewalls extending perpendicularly from two sides of a lower portion of the connecting portion in the same direction, and two elastic slices extending up slantwise from the two sidewalls; each of two corresponding conductive tabs is L-shaped, with the initial legs of the L-shapes extending parallel with each other and then extending toward each other to complete L-shapes facing each other.

5. The jumper device of claim 1, wherein the number of the plurality of conductive members is three.

6. A jumper device assembly comprising:

a jumper block mounted on a mainboard, comprising a plurality of pins;

a non-conductive casing comprising a plurality of slots defined in the casing and through one surface of the casing, and a sliding groove communicating with the slots;

a plurality of conductive members each comprising a top wall, disposed in the plurality of slots respectively and configured for electrically connecting with corresponding pins of the jumper block, the non-conductive casing being mounted to the jumper block with the plurality of pins inserted into the plurality of slots respectively to connect with the conductive members, wherein top walls of each two nonadjacent conductive members of the plurality of conductive members has a conductive tab that extends therefrom; and a switch, slidably disposed in the sliding groove, configured to selectively connect two adjacent conductive members via the top walls of the corresponding conductive members, to electrically connect two corresponding adjacent pins of the jumper block, or connect two nonadjacent conductive members via the conductive tabs of the corresponding conductive members, to electrically connect two corresponding nonadjacent pins of the jumper block.

7. The jumper device assembly of claim 6, wherein the switch comprises a sliding block, a conductive sheet attached at a bottom surface of the sliding block, and a grip handle disposed at a top surface of the sliding block, an opening is defined in a top wall of the casing in communication with the sliding groove, and the sliding block is slidably accommodated in the sliding groove with the grip handle exposed from the opening of the casing.

8. The jumper device assembly of claim 7, wherein each of the conductive members further comprises an upright connecting portion, two sidewalls extending perpendicularly from two sides of a lower portion of the connecting portion in a same direction and sandwiching a corresponding pin of the jumper block therebetween, and two elastic slices extending up slantwise from the two sidewalls; the top wall of each conductive member is perpendicularly extended from a top edge of the connecting portion in the same direction with the two sidewalls configured to contact with the conductive sheet.

9. The jumper device assembly of claim 6, wherein the plurality of slots of the casing are in such a way that the conductive members mounted therein are unconnected with each other without the switch.

10. The jumper device assembly of claim 6, wherein the number of the plurality of conductive members is three, and the conductive members are received in slots of the casing in linear alignment.

11. The jumper device assembly of claim 10, wherein the top wall of each conductive member located at opposite ends of the linear arrangement thereof, extends to form an L-shaped tab, with the initial legs of the L-shapes extending parallel with each other and then extending toward each to complete L-shapes facing each other.

* * * * *